United States Patent [19]

Van Klompenburg

[11] 4,059,298

[45] Nov. 22, 1977

[54] WINDOW LOCK

[75] Inventor: Marlo G. Van Klompenburg, Owatonna, Minn.

[73] Assignee: Truth Incorporated, Owatonna, Minn.

[21] Appl. No.: 727,257

[22] Filed: Sept. 27, 1976

[51] Int. Cl.[2] ..... E05C 3/08

[52] U.S. Cl. ..... 292/199

[58] Field of Search ..... 292/199, 112, 96, 122, 292/220, 51, 251

[56] References Cited

U.S. PATENT DOCUMENTS

| | | | |
|---|---|---|---|
| 51,222 | 11/1865 | Ridell | 292/199 |
| 148,857 | 3/1874 | Smith | 292/199 |

FOREIGN PATENT DOCUMENTS

| | | | |
|---|---|---|---|
| 189,952 | 12/1922 | United Kingdom | 292/199 |

*Primary Examiner*—Richard E. Moore

*Attorney, Agent, or Firm*—Wegner, Stellman, McCord, Wiles & Wood

[57] ABSTRACT

A lock for windows or other structures having relatively movable parts and having a lock casing and a keeper separable therefrom. A handle pivotally mounted on the casing carries a cam finger rotatable by planetary gear means including a stationary arcuate gear and a gear rotatable with the cam finger whereby, as the handle is pivoted to a locking position, the cam finger is given bodily movement to a position in alignment with the keeper and is also rotated between outward and inward positions to pick up the keeper and move it to a locked position within the casing.

10 Claims, 8 Drawing Figures

WINDOW LOCK

BACKGROUND OF THE INVENTION

This invention pertains to lock structure and, more particularly, to a window lock of a type especially useful with a casement window, wherein a keeper is mounted on the sash and the locking structure is mounted on the window frame. The sash can be drawn into locked position against the frame and initially cracked open during opening movement of the window to facilitate either manual or actuator mechanism opening of the window.

Locks for windows, such as casement windows, are generally known, wherein a keeper is mounted on the sash and a base with a pivoted handle is mounted on the frame whereby the casement window may be tightly closed and held in locked position. It is also known in such lock mechanisms to have a kick-out feature to free a frozen or swollen sash. These prior art structures did not have a pivotally-mounted handle carrying a locking element for both bodily and rotational movement to coact with a keeper.

A prior art search included U.S. Pat. Nos. 40,819, 51,222, and 352,617. The first of these patents discloses a window sash fastener wherein a pair of rollers are each rotatably mounted on an individual pivoted handle and have gear teeth for rolling along a fixed arcuate gear to move to and from a wedging position with respect to a window sash. The second patent is similar to the first, with structure for a single roller. The last-mentioned patent has a latch with rotational and reciprocable movement which is operated by a knob with an eccentrically positioned gear which interfits with gear teeth on the latch.

The aforsaid prior art patents do not disclose a lock mechanism having the structure or the operational features and advantages set forth hereinafter.

SUMMARY OF THE INVENTION

A primary feature of the invention disclosed herein is to provide a lock mechanism, particularly for windows, having new and improved structure housed within a decorative casing and which is of an economical construction having improved operating characteristics and structural features not previously known.

A principal feature of the invention is to provide a locking mechanism wherein a casing mounts a handle for pivotal movement and with the handle carrying a cam finger for rotation about an axis spaced from the axis of handle rotation and planetary gear mechanism coacts between the cam finger and the casing to cam rotational movement of the cam finger as the cam finger is being bodily moved by pivoting of the handle whereby the cam finger, in moving to a lock position in association with a keeper, first moves into alignment with the keeper and then moves the keeper to locked position.

With the structure of the invention disclosed herein, the keeper may be captured easily at a point relatively distant from the casing because of the compound movement of the cam finger with the cam finger initially extending outwardly from the casing and progressively moving to an inwardly-extending position as it moves the keeper to locked position. Conversely, in moving to an unlocked position, the cam finger moves initially to an outwardly-extending position and provides a kick-out feature to force the keeper and window sash slightly outward.

Other advantages of the lock mechanism disclosed herein are: the smooth operation resulting from the structure; the relatively high draw-in force applied to the keeper relative to the operating torque derived from the handle near the locked position; and a positive lock action whereby outward forces applied to a window sash and the keeper carried thereby cannot force the window open.

Additional advantages including the structural simplicity derived from the unique use of a geared rivet and the compactness of the structure enabling the use of an attractive, comparatively slender casing for the structure will be apparent from the description given hereinafter.

DESCRIPTION OF THE PREFERRED EMBODIMENT

Figure 1:
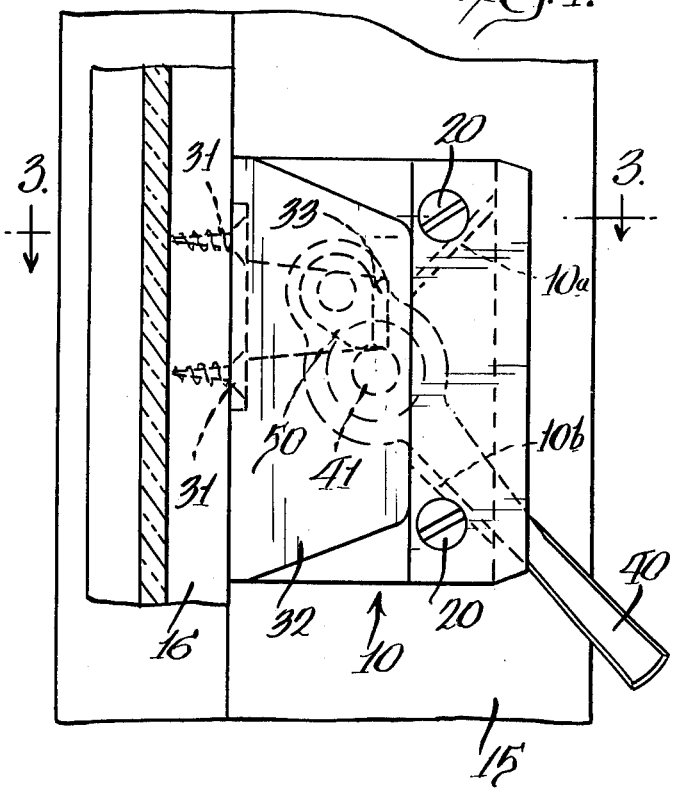
FIG. 1 is a fragmentary, side elevational view of a casement-type window showing the lock mechanism in locked position and with a part of the window sash in section.
Figure 2:
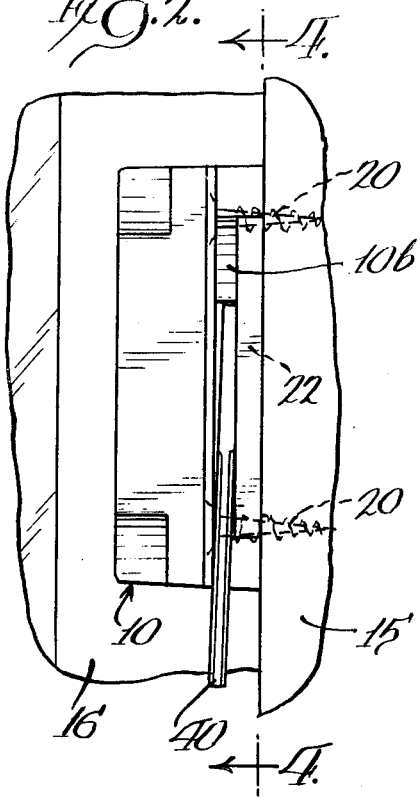
FIG. 2 is a front elevational view of the structure shown in FIG. 1 as viewed toward the left thereof.

As shown in FIGS. 1 to 4, the lock has a casing, indicated generally at 10, for receiving a keeper, indicated generally at 11. As shown in use, the casing 10 is mounted on a part 15 of a window frame and the keeper 11 is mounted on a part 16 of a window sash. The casing 10 is secured to the frame part 15 by a pair of attachment screws 20 which extend through a tubular opening in the casing and thread into the frame part 15. A back plate 22 forming part of the casing and secured to the tubular part 21 is positioned flush against the face of the frame part 15. The casing 10 has an L-shaped external contour (FIG. 3) to receive an edge of a window screen.

The keeper 11 is generally U-shape, as viewed in plan, with a base panel 30 secured to the sash part 16 by threaded members 31 and having an outwardly-extending section 32 terminating in an inturned end 33.

Figure 3:
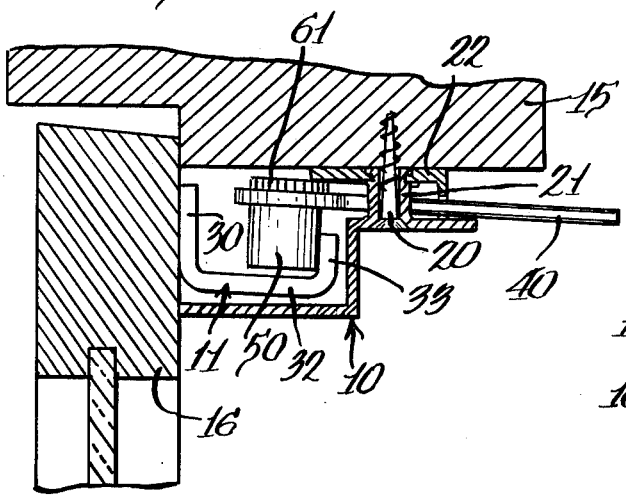
FIG. 3 is a plan section, taken generally along the line 3—3 in FIG. 1.
Figure 4:
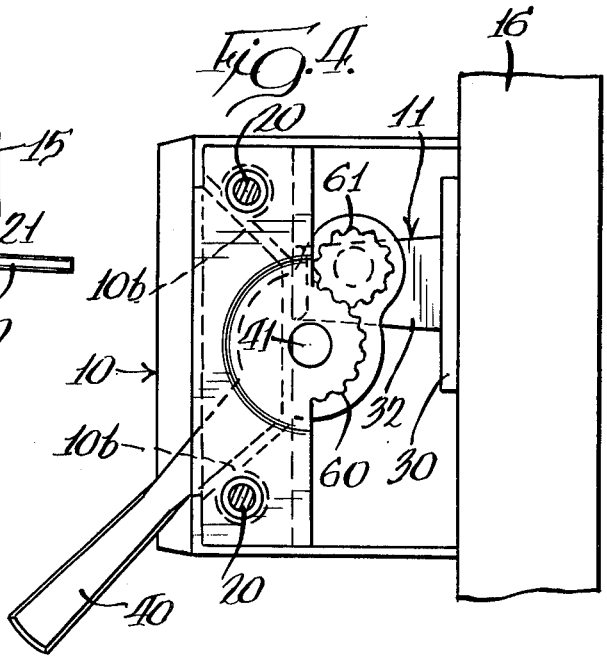
FIG. 4 is a sectional view, taken generally along the line 4—4 in FIG. 2 to show the lock structure as viewed from the back side thereof.

As shown in the locked position of FIGS. 1 to 4 and, particularly in FIG. 3, the keeper 11 fits within an enlarged part of the casing 10 which opens outwardly to permit passage of the keeper into the interior of the casing.

A handle 40, positioned within the interior of the room, is pivoted intermediate its ends (FIG. 8) to the back plate 22 by means of a rivet 41 extending through an opening 42 in the handle and an opening in the back plate 22. A spring washer 43 engages between the handle 40 and the back plate 22 to hold the handle in any desired position other than the locked position of the handle which is the lowermost position thereof, as shown in FIG. 1. The rivet 41 defines a pivot axis for the handle whereby the handle can move in a space between the back plate and the casing cover from the locked position, shown in FIGS. 1 to 4, and a full release or unlocked position, shown in FIG. 7. In the locked position, the handle engages a support surface 10*a* of the casing and in the unlocked position engages a casing surface 10*b*.

Figure 8:
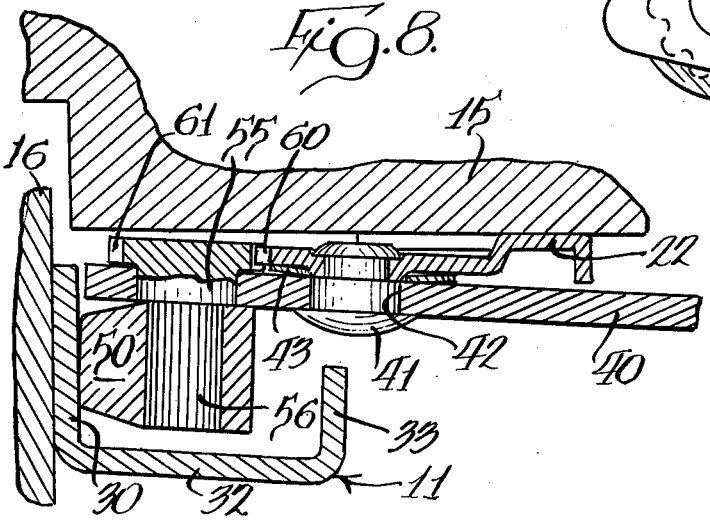
FIG. 8 is a sectional view, taken generally along the line 8—8 in FIG. 6.

As shown in FIG. 8, the back plate 22 and handle 40 are at a slight angle to the frame part 15 to provide additional clearance for handle operation.

A cam finger 50 is carried by the handle 40 for bodily movement and also for rotation during pivoting of the handle. The cam finger 50 is mounted on the handle 40 by means of a rivet 55 which is rotatably mounted in the handle 40 and has a splined tenon 56 press-fitted into a hole in the cam finger.

The means for rotating the cam finger in response to pivotal movement of the handle 40 comprises planetary gear means including arcuately arranged gear teeth 60 on an arcuate exposed end of the back plate 22 and which mesh with a gear 61 provided by teeth formed on the head of the rivet 55. With this construction, the handle 40 and cam finger 50 both rotate in the same direction.

Figure 5:
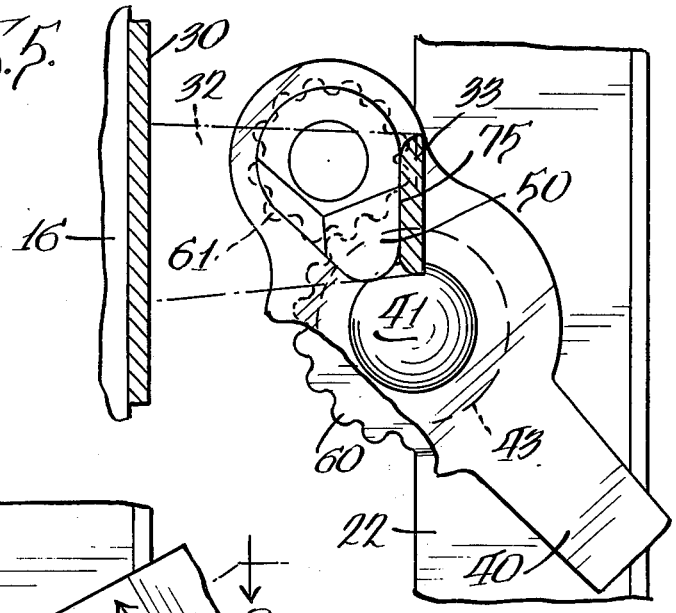
FIG. 5 is a fragmentary view, with parts broken away, of the structure shown in FIG. 1 and showing the parts in locked position.
Figure 7:
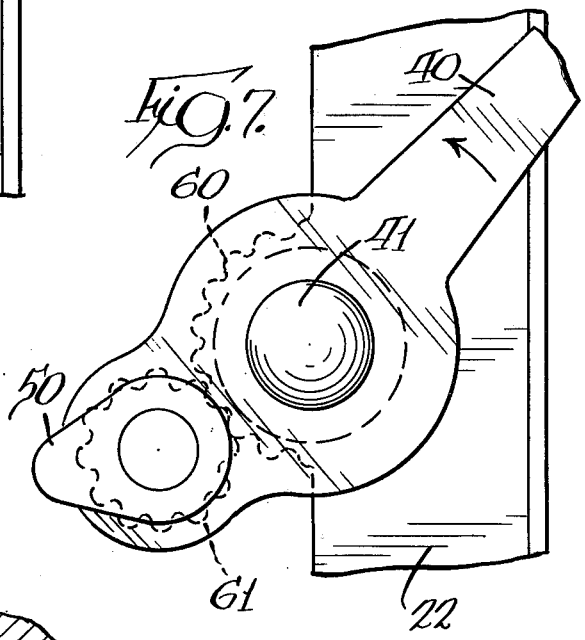
FIG.7 is a view of the structure, similar to FIG. 5 with the keeper omitted and showing the lock structure in unlocked position.

The cam finger 50 is shaped to extend beyond the point of rolling contact between the gears, as shown in FIGS. 7 and 8, whereby in the fully-unlocked position of the handle 40, as shown in FIG. 7, the cam finger extends outwardly and, in moving to the locked position, as shown in FIG. 5, the cam finger rotates through more than 180° to move through an inwardly-extending position ultimately to a downwardy-extending position, shown in FIG. 5.

In the locked position of FIG. 5, the handle 40 is resting upon the support surface 10*a* of the casing 10 (FIG. 4) whereby the handle cannot move any additional distance downwardly. If an outward force is applied against the window sash, the resulting outward force exerted by the end 33 of the keeper is applied against the cam finger 50. This force acts in a direction to rotate the cam finger clockwise, as viewed in FIG. 5. However, such rotation would require the cam finger gear 61 to move upwardly along the fixed arcuate gear 60 and this can only occur through further downward movement of the handle 40, which is not possible. Thus, the keeper 11 is held positively in the locked position and normal outward forces on the sash cannot disengage the keeper.

Figure 6:
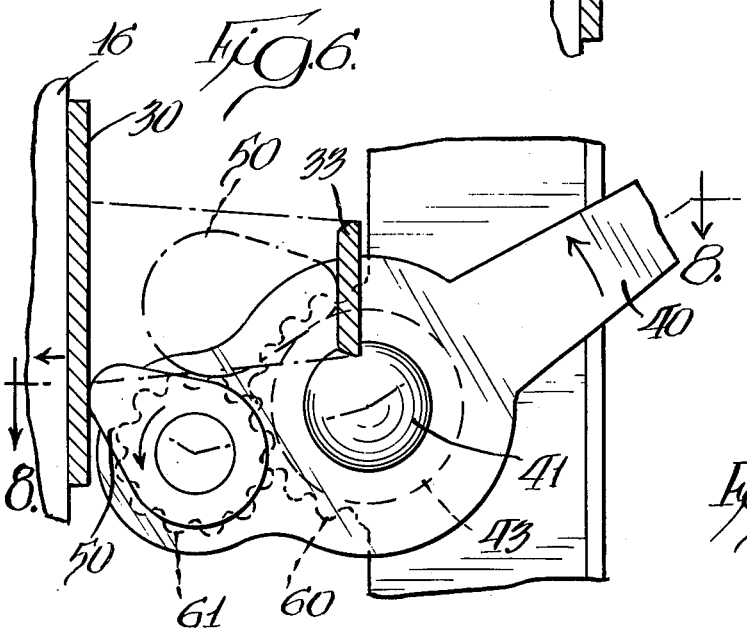
FIG. 6 is a view of the structure shown in FIG. 5, showing the structure imparting a kick-out action to the keeper and with an intermediate position of a cam finger shown in broken line.

The unlocking action is shown particularly in FIG. 6 wherein the handle 40, in moving upwardly, causes simultaneous bodily and rotational movement of the cam finger 50 to the broken line position shown in FIG. 6 and, subsequently, there is bodily and rotational movement of the cam finger 50 to the position shown in full line in FIG. 6, wherein the cam finger engages the base plate 30 of the keeper. Continuing movement from the last-mentioned position exerts an outward force on the window sash to provide a kick-out feature which frees the window sash for further opening movement either directly by hand or through an operating mechanism of the type used in this art. The final position in unlocking is shown in FIG. 7 wherein the cam finger 50 is moved to a position out of the path of travel of the inner end 33 of the keeper 11.

In locking of the window, the cam finger 50 is positioned, as shown in FIG. 7, extending outwardly and initial pivoting of the handle brings the cam finger 50 into alignment with the keeper inner end 33. Further movement of the cam finger draws the keeper into the casing. The movement of the cam finger includes bodily inward movement as the cam finger moves rotationally to the final position of FIG. 5 wherein a relatively flat face 75 of the cam finger engages the face of the keeper inner end 33. With this structure, it will be seen that the bodily and rotational movement of the cam finger 50 imparts a total throw thereto whereby the keeper can easily be captured, even when relatively distant from the casing 10 as might result if the window sash were not fully closed prior to operation of the lock mechanism. Near the locked position of FIG. 5, the mechanism inherently has a relationship between operating torque and draw-in forces exerted on the keeper which exhibits a higher draw-in force near the locked position to permit easy positioning of the sash and lock mechanism in final locked position.

I claim:

1. A lock having a casing and a separate keeper with spaced-apart members for locking to the casing, a cam finger engageable with one of said keeper members to draw said keeper toward the casing and lock the keeper to the casing and engageable with the other keeper member to initiate movement of the keeper from the casing, a handle mounted on said casing for pivotal movement about a pivot axis and having means thereon defining a second axis movable by handle pivoting to and from a position between said spaced-apart members, means mounting said cam finger on said handle for rotation about said second axis remote from said pivot axis, and means operable during pivoting of said handle and bodily movement of said cam finger to cause rotation of the cam finger about said second axis from a position pointing toward one keeper member to a position pointing toward the other keeper member.

2. A lock as defined in claim 1 wherein said means for causing rotation of the cam finger comprises a planetary gear drive.

3. A lock as defined in claim 2 wherein said planetary gear drive includes a first arcuate gear fixed to said casing and a second gear rotatable with said cam finger and in mesh with said first arcuate gear.

4. A lock as defined in claim 3 wherein said cam finger is rotatably mounted to said handle by means of a rivet secured to said cam finger and the head of said rivet is formed to provide said second gear.

5. A lock having a casing and a separate keeper for locking to the casing, a cam finger engageable with said keeper to draw said keeper toward the casing and lock the keeper to the casing, a handle mounted on said casing for pivotal movement about a pivot axis, means mounting said cam finger on said handle for rotation about a second axis remote from said pivot axis, and means operable during pivoting of said handle and bodily movement of said cam finger to cause rotation of the cam finger about said second axis comprising a planetary gear drive including a first arcuate gear fixed to said casing and a second gear rotatable with said cam finger and in mesh with said first arcuate gear, said cam finger extending outwardly when in an unlocked position and with said arcuate gear having a length whereby rotation of the handle to a lock position carries said cam finger to a position to engage behind said keeper and also rotates said cam finger through more than 180° to position the cam finger extending inwardly and draw the keeper to locked position.

6. A lock as defined in claim 5 wherein said handle engages said casing in locked position and said cam finger in locked position is held against rotation resulting from an unlocking force supplied to said keeper by said gear mesh and handle.

7. A lock having a casing and a separate keeper for locking to the casing, a cam finger engageable with said keeper to draw said keeper toward the casing and lock the keeper to the casing, a handle mounted on said casing for pivotal movement about a pivot axis, means mounting said cam finger on said handle for rotation about a second axis remote from said pivot axis, and means operable during pivoting of said handle and bodily movement of said cam finger to cause rotation of the cam finger about said second axis, said keeper being generally U-shape with a pair of spaced-apart legs and with said cam finger engaging behind one leg in a locking position and movable in an unlocking direction to engage said other leg and move the keeper away from said casing.

8. A window lock having a casing with a back plate attachable to a window frame and a keeper attachable to a window sash, a handle mounted within said casing for movement about a pivot axis intermediate the ends of the handle, a cam finger rotatably mounted on said handle adjacent an end of the handle whereby an end of the finger may travel in an arc, and gear means including an arcuate gear on the back plate and a meshing gear rotatable with the cam finger for causing rotation of the cam finger as the handle moves between sash locking and unlocking positions and bodily moves said cam finger to and from a position aligned with the keeper, said cam finger in an unlocked position extending away from the casing and in bodily moving toward a locked position also rotating to a position extending toward the casing.

9. A window lock having a casing with a back plate attachable to a window frame and a keeper attachable to a window sash, a handle mounted within said casing for movement about a pivot axis intermediate the ends of the handle, a cam finger rotatably mounted on said handle adjacent an end of the handle whereby an end of the finger may travel in an arc, and gear means including an arcuate gear on the back plate and a meshing gear rotatable with the cam finger for causing rotation of the cam finger as the handle moves between sash locking and unlocking positions and bodily moves said cam finger to and from a position aligned with the keeper, said cam finger in an unlocked position extending toward a window sash and in moving toward a locked position rotating to a position extending away from the window sash, said handle engaging said casing in locked position to prevent further movement of the handle, rotation of the handle to locked position causing said cam finger to rotate in one direction to engage the keeper and the cam finger engagement with the keeper being beyond the rolling contact of the gear means whereby an opening force applied to the keeper urges the cam finger to rotate further in said one direction and which rotation is prevented by the gear mesh and the handle engagement with the casing.

10. A window lock having a casing with a back plate attachable to a window frame and a keeper attachable to a window sash, a handle mounted within said casing for movement about a pivot axis intermediate the ends of the handle, a cam finger rotatably mounted on said handle adjacent an end of the handle whereby an end of the finger may travel in an arc, and gear means including an arcuate gear on the back plate and a meshing gear rotatable with the cam finger for causing rotation of the cam finger as the handle moves between sash locking and unlocking positions and bodily moves said cam finger to and from a position aligned with the keeper, said cam finger being rotatably mounted on said handle by means of a rivet secured to said cam finger and the head of said rivet is formed with gear teeth to define said meshing gear.

* * * * *